US011036246B1

(12) United States Patent
Kavousian

(10) Patent No.: US 11,036,246 B1
(45) Date of Patent: Jun. 15, 2021

(54) GEAR SHIFTING LOW DROP OUT REGULATOR CIRCUITS

(71) Applicant: Verily Life Sciences LLC, Mountain View, CA (US)

(72) Inventor: Amirpouya Kavousian, San Jose, CA (US)

(73) Assignee: Verily Life Sciences LLC, Mountain View, CA (US)

( * ) Notice: Subject to any disclaimer, the term of this patent is extended or adjusted under 35 U.S.C. 154(b) by 95 days.

(21) Appl. No.: 16/131,731

(22) Filed: Sep. 14, 2018

Related U.S. Application Data

(60) Provisional application No. 62/558,761, filed on Sep. 14, 2017.

(51) Int. Cl.
*G05F 1/575* (2006.01)

(52) U.S. Cl.
CPC ..... *G05F 1/575* (2013.01)

(58) Field of Classification Search
CPC ..... G05F 1/59; G05F 1/575
See application file for complete search history.

(56) References Cited

U.S. PATENT DOCUMENTS 7,218,168 B1 * 5/2007 Rahman ..... G05F 1/56 323/273
9,535,439 B2 1/2017 Jain et al.
2009/0040677 A1 2/2009 Ryoo
2010/0052635 A1 * 3/2010 Wang ..... G05F 1/575 323/280
2014/0070878 A1 * 3/2014 Kawasaki ..... G06F 1/263 327/543
2014/0091775 A1 * 4/2014 Tan ..... G05F 1/575 323/280
2015/0109057 A1 * 4/2015 Rouat ..... H03G 1/0088 330/254
2016/0004267 A1 * 1/2016 Atrash ..... G05F 1/565 323/280
2016/0218613 A1 7/2016 Hussien et al.
2018/0226981 A1 * 8/2018 Salem ..... H03M 1/462
2019/0107856 A1 * 4/2019 Lim ..... G05F 1/59

FOREIGN PATENT DOCUMENTS

EP 2887174 A1 6/2015

* cited by examiner

*Primary Examiner* — Rafael O De Leon Domenech
(74) *Attorney, Agent, or Firm* — Perkins Coie LLP

(57) ABSTRACT

An electronic circuit includes a differential amplifier, an output stage and a control circuit. The differential produces a signal proportional to a difference between a reference voltage and a voltage that is proportional to the output signal. The output stage includes multiple switchable circuits coupled between a voltage source and the output terminal such that the switching of the circuits changes impedance between the voltage source and the output terminal. The control circuit receives a feedback indicative of the voltage of the output signal and controls the impedance of the multiple switchable circuits such that current flowing out of the voltage source rises piecewise smoothly from power-on to steady state operation of the electronic circuit.

18 Claims, 6 Drawing Sheets

300

GEAR SHIFTING LOW DROP OUT REGULATOR CIRCUITS

CROSS-REFERENCE TO RELATED APPLICATIONS

This patent document claims priority to U.S. Provisional Patent Application 62/558,761 entitled "Gear Shifting Low Drop Out Regulator Circuits," filed on Sep. 14, 2017. The entire content of this provisional application is incorporated by reference into the present patent document.

TECHNICAL FIELD

Various embodiments concern techniques for reducing power-on current surge in an electronic circuit.

BACKGROUND

Electronic circuits are often powered on and off during operation. Signal fluctuations during power up and power down may be detrimental to the durability of an electronic circuit and other circuit components around it. Medical devices with electronics are an example of devices where circuits may be frequently powered up or powered down.

SUMMARY

Example embodiments for circuit implementations of a power-on current surge limiting technique are disclosed.

In one example aspect, a circuit is disclosed. The circuit includes a differential amplifier that has a first input terminal coupled to a reference voltage source, a second input terminal coupled to a scaled version of an output voltage at an output terminal of the circuit, and a differential output terminal. The differential amplifier is configured to produce, at the differential output terminal, a difference signal representing a difference between voltage signals at the first input terminal and the second input terminal. The circuit further includes an output stage coupled between a source terminal coupled to a voltage source and the output terminal of the circuit. The output stage is coupled to the differential output terminal, and includes multiple circuit branches positioned between the voltage source and the output terminal. The circuit also includes a control circuit that controls an impedance value of the output stage between the voltage source and the output terminal by varying at least one property of the multiple circuit branches based on a feedback signal. The circuit also includes a voltage divider circuit that is configured to produce the feedback signal as a fraction of an output voltage at the output terminal.

In another example aspect, a method of controlling current being drawn by a circuit from a voltage source during power-up of the circuit is disclosed. The method includes operating, in an initial time interval immediately after powering on the circuit, an output stage between the voltage source and an output terminal in a high impedance state. The method further includes operating, during successive time intervals after the first time interval and until the circuit reaches a steady state operation, the output stage in successively lower impedance states in which successively lower impedance is offered between the voltage source and the output terminal, thereby controlling current drawn from the voltage source to be a piecewise smooth function of time.

In yet another example aspect, an electronic circuit is disclosed. The circuit includes a feedforward path circuit having a first terminal coupled to a reference voltage, a second terminal coupled to an output terminal and a third terminal coupled to a voltage source, the feedforward path circuit having a variable impedance, a feedback path circuit configured to provide a feedback voltage at a feedback terminal, wherein the feedback voltage represents a scaled value of the output voltage, and a controller circuit coupled to the feedforward path circuit and the feedback path circuit and configured to control the variable impedance based on the feedback voltage such that the value of the variable impedance is proportional to a difference between a voltage value of the voltage source and a voltage value at the output terminal.

These, and other features, are further described throughout the present document.

BRIEF DESCRIPTION OF THE DRAWINGS

Various features and characteristics of the technology will become more apparent to those skilled in the art from a study of the Detailed Description in conjunction with the drawings. Embodiments of the technology are illustrated by way of example and not limitation in the drawings, in which like references indicate similar elements.

FIG. 1 shows an example of a low dropout regulator circuit without a mechanism to control in-rush current upon power on.

FIG. 2 is a graphical illustration of in-rush current when a low dropout regulator circuit such as the one depicted in FIG. 1 is powered on.

Figure 1:
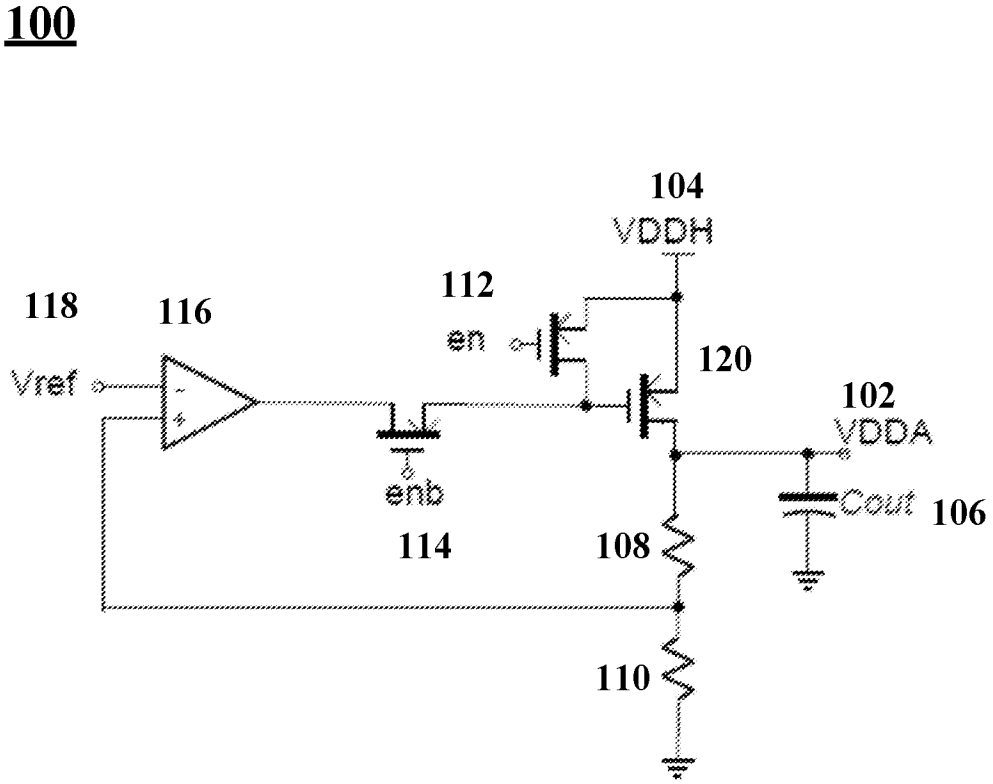

The drawings depict various embodiments for the purpose of illustration only. Those skilled in the art will recognize that alternative embodiments may be employed without departing from the principles of the technology. Accordingly, while specific embodiments are shown in the drawings, the technology is amenable to various modifications.

DETAILED DESCRIPTION

During operation, electronic circuits are often powered-on and powered-off. While a designer of the electronic circuit may select component values (e.g., values of resistors, capacitors, type of transistors used, etc.) to provide voltage and current values in a desired range when the circuit is in steady state operation, the actual current or voltage values during the transition periods, e.g., when power is applied to a circuit or turned off from the circuit, may fluctuate and deviate significantly from the steady state values.

One possible detrimental effect of such fluctuations may be in reducing the life expectancy of the electronic components. The other possible disadvantage may be reducing battery life and/or a drop in the battery voltage due to a surge in the current being drawn by the circuit. Yet another possibility is that large swings in current, however short-term they may be, may damage electronic components or harm a user of the electronic circuit.

The techniques described in the present document can be used to build and operate electronic circuits that control the voltage and current swings during the transition period of an electronic circuit. In some embodiments, current being drawn from the power source may be controlled to be piecewise smooth, starting with zero ampere, and reaching its steady state value. In some embodiments, the current and voltage swings may be controlled by changing impedance between the voltage source and the output terminal of the circuit such that the impedance is high immediately upon power-up and is progressively reduced during the transition time after power-on. The progressive reduction may be performed by monitoring the rising value of voltage at the output voltage from zero volts to its steady state value.

FIG. 1 depicts an example of a circuit 100 using which the problem of high in-rush currents can be explained. When this circuit 100 is turned on from zero-voltage stage the output terminal is typically at zero volts and a large amount of current may be drawn from the voltage source VDDH 104 during the time the output capacitor 106 charges to provide the steady state output voltage VDDA at the output terminal 102.

The comparator 116 may produce at its output terminal a signal proportional to the different between reference voltage Vref 118 at one input terminal and a fraction of the output voltage 102, where the fraction is determined by the ratio of resistors 108 and 110. The transistors 112, 114 and 120 collectively may form the output stage of the circuit 100 and can be operated to control the value of voltage at the output terminal. Various configurations of the transistor circuits are used in conventional low dropout regulator circuits. These configurations include a Darlington pair configuration, an NPN configuration, a PNP configuration, a PMOS configuration and an NMOS configuration. At steady state, the voltage output VDDA 102 will be proportional to and a scaled version of the reference signal voltage 118. The circuit 100 may thus perform the function of a low dropout regulator that provides a relatively constant VDDA at the output terminal regardless of small fluctuations in the source voltage VDDH 104.

Figure 2:
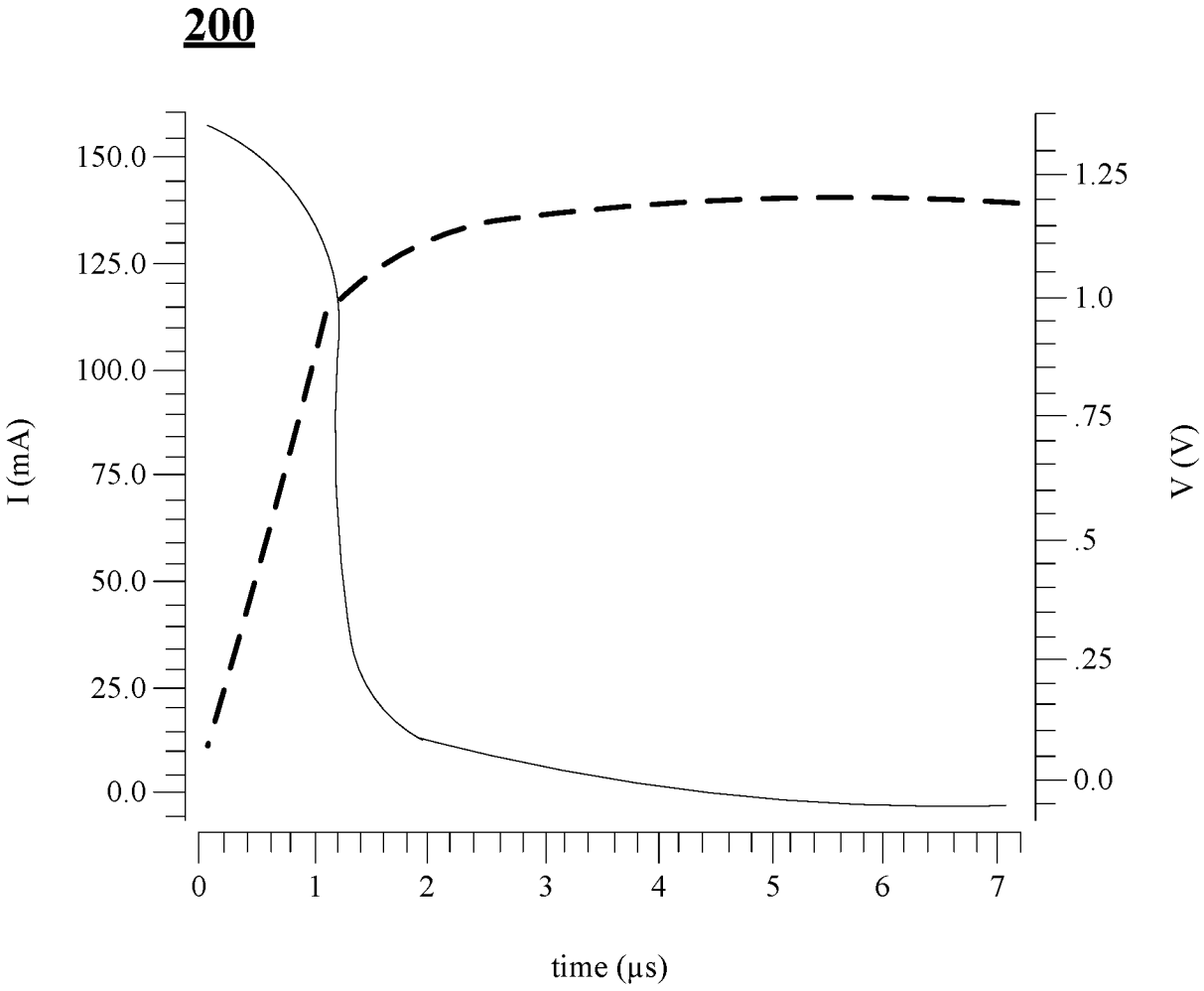

FIG. 2 shows an example graph 200 that depicts the behavior of circuit 100 during the power-on transition period. The horizontal axis represents time (in microsecond) elapsed since power was applied to the circuit 300 and the left and right vertical axes represent the output voltage and the current drawn from the supply voltage. It will be understood that similar transient behavior is expected from other low dropout circuit, except the time scale may be different and will depend on values of circuit components.

The graph 200 shows that, immediately after power-up, a large amount of current is drawn from the battery (e.g., in the first one microsecond in the depicted graph). During this time, the output voltage value ramps up from zero to its steady state value. In the depicted example, after about 4 microseconds, the current and voltage values are sufficiently close (e.g., within 90%) to their steady state values. Referring to FIG. 1, the reason for the high initial value of the current is that, when the power is turned on, the capacitor is not charged, and therefore there is large in-rush current due to the low impedance between the voltage source and the output terminal.

As can be seen from FIG. 1 and FIG. 2, the conventional circuits do not have the ability to control the impedance between the voltage source and the voltage sink (output terminal or ground). Furthermore, this impedance is often primarily due to a transistor circuit, which itself operates with gate bias voltage arrangement in which the impedance of the circuit tends to be low at the power-on of the circuit, and then becomes higher as the circuit reaches steady state.

The techniques described in the present document can be used in embodiments that overcome these, and other, limitations of the conventional circuits such as the low dropout regulator and other electronic circuits. As further described in the present document, a control mechanism is used to control operation of a circuit such that, upon power-up, the impedance of the output stage is high and the impedance is successively reduced to a steady-state value by monitoring the output voltage. In another advantageous aspect, the output voltage monitoring is performed using a feedback signal that is a scaled version of the output voltage, where the scaling is also changed in a way that simplifies the monitoring of the output voltage.

Figure 3:
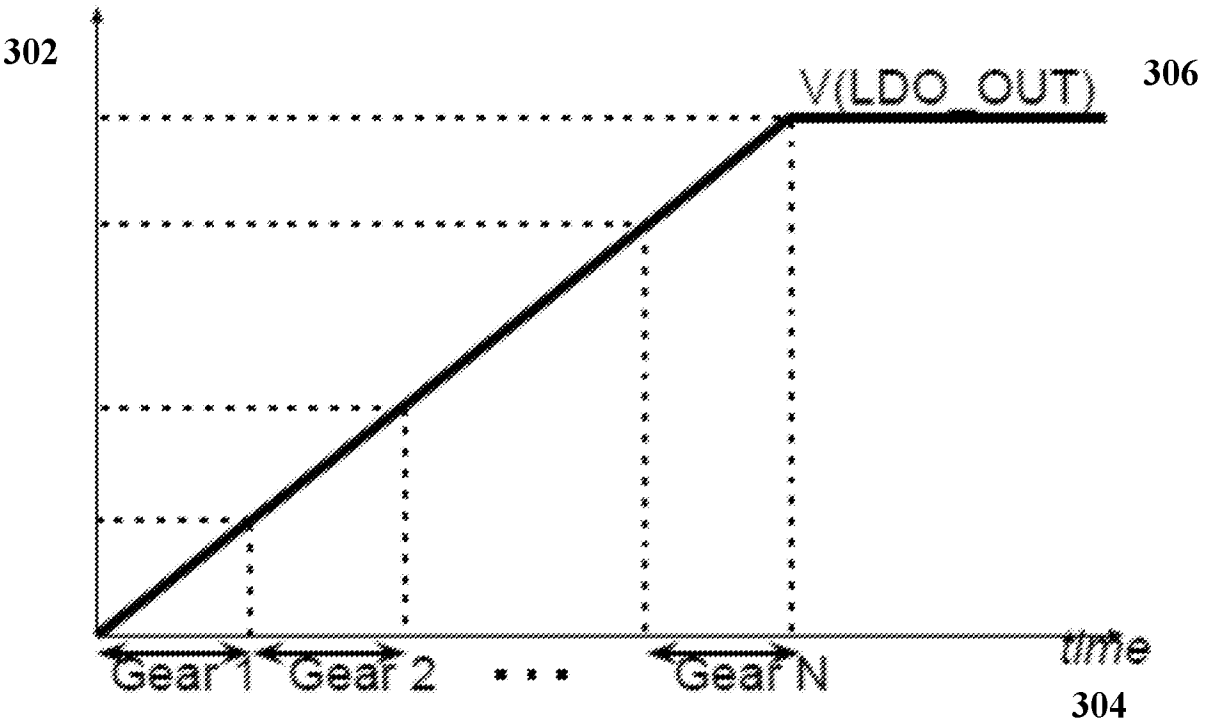
FIG. 3 is a graphical illustration of an example of a power-on signal behavior in some embodiments described herein.

The graph 300 in FIG. 3 depicts an example of a timing relationship of the output voltage of a circuit (curve 306) plotted along the vertical axis 302 as a function of time (horizontal axis 304). Compared to the graph in FIG. 2, in this example, voltage swing upon start-up is controlled. The curve 306 may be piecewise smooth, e.g., piecewise linear, as a function of time. For example, during each of the time intervals labeled Gear 1, Gear . . . to Gear N, the current may rise at a relatively smooth (e.g., linear) rate. A similar curve may be seen for the current being drawn from the voltage source also. The term "gear" refers to a characteristic of the circuit during a corresponding time period such that the circuit produces a voltage (or current) output that linearly increases with time during the interval. This characteristic may be, for example, impedance of the circuit that draws current from the voltage source. The slope of this linear portion in each gear interval may depend on the actual value of the "gear ratio," (e.g., impedance) which may be controlled by a circuit parameter such as a value of circuit impedance. The circuit may operate by changing the gear ratio from time to time to provide a smooth ramp-up in the voltage at power-up. For example, in some embodiments described in the present document, a technique of controlling the impedance between the voltage source and the output terminal to be proportional to the value of the output voltage may be used to achieve piecewise smooth behavior. For example, in some embodiments, the piecewise smooth function of time may be breakable into distinct pieces corresponding to different time intervals and, on each piece, both the function and its derivative may be continuous. For example, the piecewise smooth function may not be continuous at all times, however the only discontinuities that are allowed are a finite number of jump discontinuities. As further described in this document, the discontinuities may occur when the impedance of forward stage is switched to a different value. The piecewise continuity may thus refer to change in the output current or voltage per switchable branch. For example, a piecewise smooth function may be such that the output voltage does not have a step up or step down (e.g., non-infinite/non-exponential derivative) in response to a change to the property of a switchable branch at a time instant.

Figure 4:
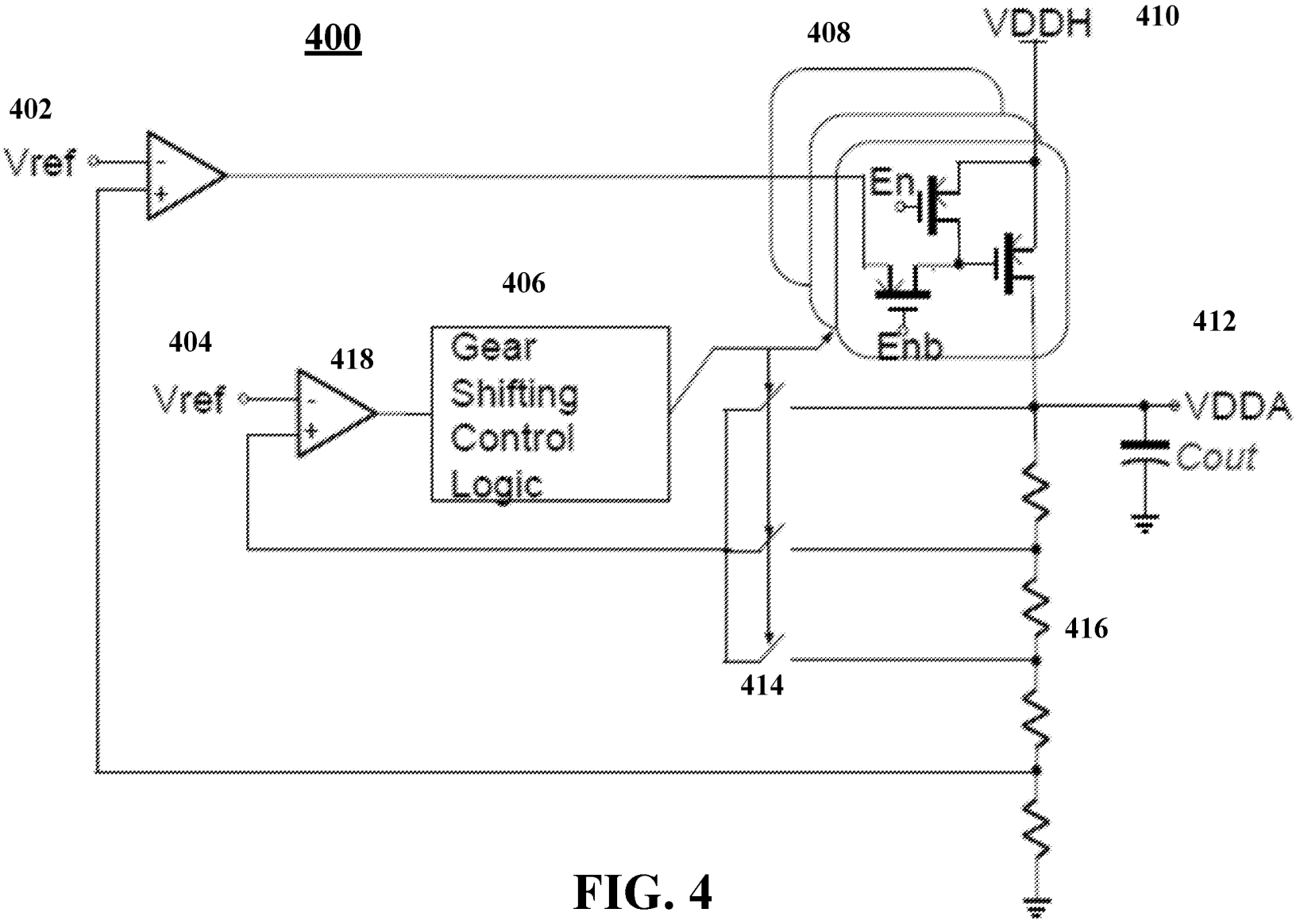
FIG. 4 is a circuit diagram of an example implementation of an electronic circuit according to some embodiments described herein.

FIG. 4 shows an example circuit 400 which may be used to achieve a piecewise linear increase in the voltage output by the voltage regulator circuit, e.g., as described with respect to FIG. 3. The circuit 400 includes a differential amplifier 402. The differential amplifier 402 includes a first terminal, marked with a "–" (minus), and a second terminal, marked with a "+" (plus). These two terminals are coupled to a reference voltage source Vref and a scaled version of the output voltage at the output of the circuit 400, respectively. The differential output terminal of the differential amplifier 402 is coupled to digital control logic output stage 408. The differential amplifier 402 operates to produce, at the output terminal of the differential amplifier, an output voltage that is proportional to the difference between values of voltages applied to the first input terminal and the second input terminal.

The output stage 408 is coupled between a source terminal coupled to a voltage source and the output terminal of the circuit 400. The output stage 408 is further coupled to the differential output terminal. The output stage 408 includes multiple circuit branches positioned between the voltage source and the output terminal.

The output stage 408 may be operated such that the impedance between the voltage source and the output terminal of the circuit 400 may be changeable during the operation of the circuit. For example, the multiple circuit branches may be switched to alter the number of circuit branches in series or in parallel, to change the impedance.

In operation, the circuit 400 may be operated using the gear shifting control logic (GSCL) 406 that controls the operation of the circuit 400 by generating two control signals. One control signal controls the switching of the switch bank 414 so that the fraction of the output voltage 412 that is fed back to the comparator 418 is adjusted, as further described below. The other control signal controls the number of circuit branches in the output stage 408 that are electrically connected into the circuit 400 to alter the impedance between the voltage source 10 and the output 412.

Immediately after turning on the circuit 400, the output voltage VDDA 412 will typically be zero. Upon power-on, current will begin to flow from the supply voltage 410, through the output stage 408. As a result, the VDDA 412 will being to rise. During this time, since the voltage difference between the supply voltage 410 and the output terminal 412 is high, the GSCL 406 may control the impedance of the output stage 408 to be high, thereby resulting in only a small value of current flowing out of the voltage source. In some embodiments, the output stage 408 may include a number of identical transistor circuits, and the GSCL 406 may control the number of actively used transistor circuits to vary the impedance. For example, when a parallel configuration is used, and the impedance of one circuit is represented as X(t) (where t is time), then two actively used circuits in parallel may result in X(t)/2 impedance. Alternately, if a serial configuration is used, then two active circuits may represent 2*X(t) impedance.

When value of the VDDA 412 begins to rise, the voltage at the plus terminal of the comparator 418 begins to rise in proportion to a fraction of the output voltage VDDA, as determined by the ratio of the switch bank. The fraction, or dividing ratio, used for the feedback signal may also be adjusted from one gear interval to another so that the design of the comparator can be simplified. For example, the scaling of the feedback signal may be such that at the end of a given gear cycle, the output voltage rises to a level which results in the feedback signal reaching the value of the reference signal used at the comparator.

An illustrative example is as follows. The reference voltage Vref may be 1 volt. Furthermore, steady state output voltage of the circuit may be 4 Volts. The GSCL 406 may control the impedance of the output stage 408 in four stages—one gear interval during which the output voltage is between 0 and 1 volts, a second gear interval during which the output voltage is between 1 volt and 2 volts, a third gear interval during which the output voltage is between 2 volts and 3 volts and a fourth gear interval during which the output voltage goes from 3 volts to the steady state value of 4 volts.

At power on, the output stage 408 may be controlled to have a high impedance, which then causes a small amount of current to flow out of the supply terminal. During this interval, the GSCL 406 may control the switch bank 414 such that the resistors 416 operate to provide 100% of the output voltage value as the feedback signal. The comparator 418 may thus provide an indication to the GSCL 406 information about when the output voltage reaches 1 volt. At this time, the GSCL 406 may control the output stage 408 to have a lower impedance so that the output voltage at the output terminal keeps rising beyond 1 volt. Simultaneous with the re-programming of the output stage, the GSCL 406 may operate the switch bank 414 to change the resistive ratio of the resistors 416 such that the plus terminal of the comparator 418 now receives a voltage value that is one half of the output voltage value. The output voltage will keep rising such that the voltage value at the plus terminal will rise from 0.5 volts upwards, while the output voltage rises from 1 volt to 2 volts. When the value reaches 1 volt, the comparator 418 will again indicate to the GSCL 406 that the plus terminal voltage is now at or exceeding the minus terminal voltage (Vref=1 volt). The GSCL 406 may reprogram the output stage 408 to further reduce its impedance, and at the same time, may operate switch bank 414 to provide one-third of the output voltage value as the feedback signal to the comparator 418. In this gear interval, the voltage value at the plus terminal of the comparator 418 thus rises from an initial value of ⅔ volts (when the output voltage is 2 V) to 1 volt (when the output voltage reaches 3V). The GSCL 406 may again reduce impedance of the output stage and alter the ratio of the output signal being fed back as the feedback signal to be ¼. Thus, in the fourth gear interval, the feedback signal will start from ¾ volt and reach up to 1 volt. At steady state, the output voltage reaches its steady state value and the output stage now operates as a conventional LDO circuit.

Referring back to FIG. 2, in the first one or two microseconds, or in general an early part of the time after power-on, the curves shown in FIG. 2 show when the output voltage is zero or near-zero, a large amount of current is drawn from the power source. By contrast, in the circuit 400 of FIG. 4, when the output voltage is zero or near-zero, a large amount of impedance is applied between ground and the voltage supply, and thus the amount of current withdrawn in kept limited. Furthermore, this impedance is progressively reduced as the voltage at the output terminal begins to rise, thereby changing the slope of the piecewise smooth function.

For example, as the value of current rises, the impedance experienced by the voltage source may be changed in different steps (or gears) based on circuit impedance so that the current rises in a relatively linear or piece-wise linear manner.

Figure 5:
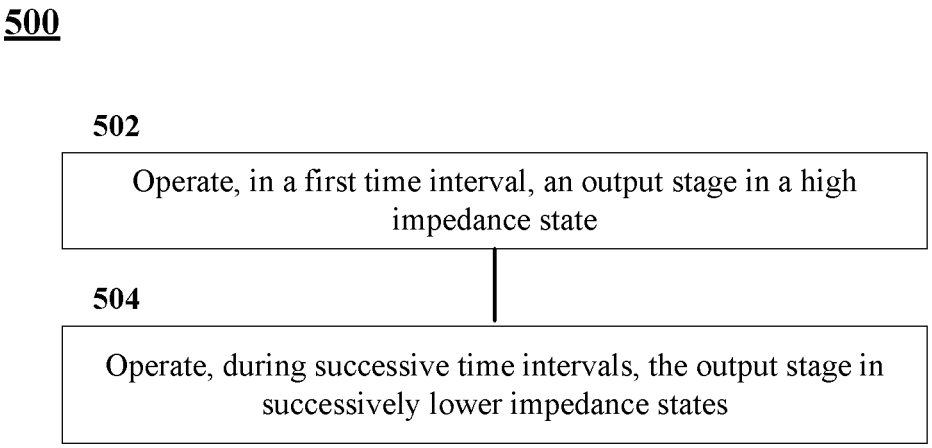
FIG. 5 is flowchart of an example method of operating an electronic circuit.

FIG. 5 is a flowchart for an example method 500 for controlling in-rush current of an electronic circuit. The method 500 may be used to control current being drawn by a circuit from a voltage source during power-up of the circuit. The method 500 includes, at 502, operating, during a first time interval immediately after powering on the circuit, an output stage between the voltage source and an output terminal in a high impedance state. The method 500 includes, at 504, operating, during successive time intervals after the first time interval and until the circuit reaches a steady state operation, the output stage in successively lower impedance states in which successively lower impedance is offered between the voltage source and the output terminal, thereby controlling current drawn from the voltage source to be a piecewise smooth function of time.

The method 500 may further include generating, during the first time interval and the successive time intervals, a feedback signal that is a fraction of a value of voltage at the output terminal, wherein the fraction is changed for each time interval and controlling the output stage to offer successively lower impedance using a difference between the feedback signal and a reference signal at a reference terminal.

In some embodiments, the time intervals may be equal. In some embodiments, the time intervals may have different durations. As depicted in FIG. 3, in some embodiments, the piecewise smooth function may be a piecewise linear function. During each interval, the slope of the corresponding line may depend on the number of transistor circuits of the output stage used. In some embodiments, the transistor circuits may include bipolar junction transistors (BJTs). The transistor circuits may include field effect transistor circuits (FET). In some embodiments, npn or pnp transistors circuits, or PMOS or NMOS transistors, may be used to achieve low dropout regulation of the output voltage. For example, the transistors may be arranged in a Darlington pair configuration.

The functionality of the circuit 400, described with reference to FIG. 4, may also be achieved using other arrangements of electronics components such as transistors, capacitors, and resistors. In some embodiments, the disclosed techniques can be implemented without having a need to use inductors in the circuit. The duration of gear intervals may be programmable or may be fixed a priori based on the values of resistors in series, as in the switch bank 414.

Figure 6:
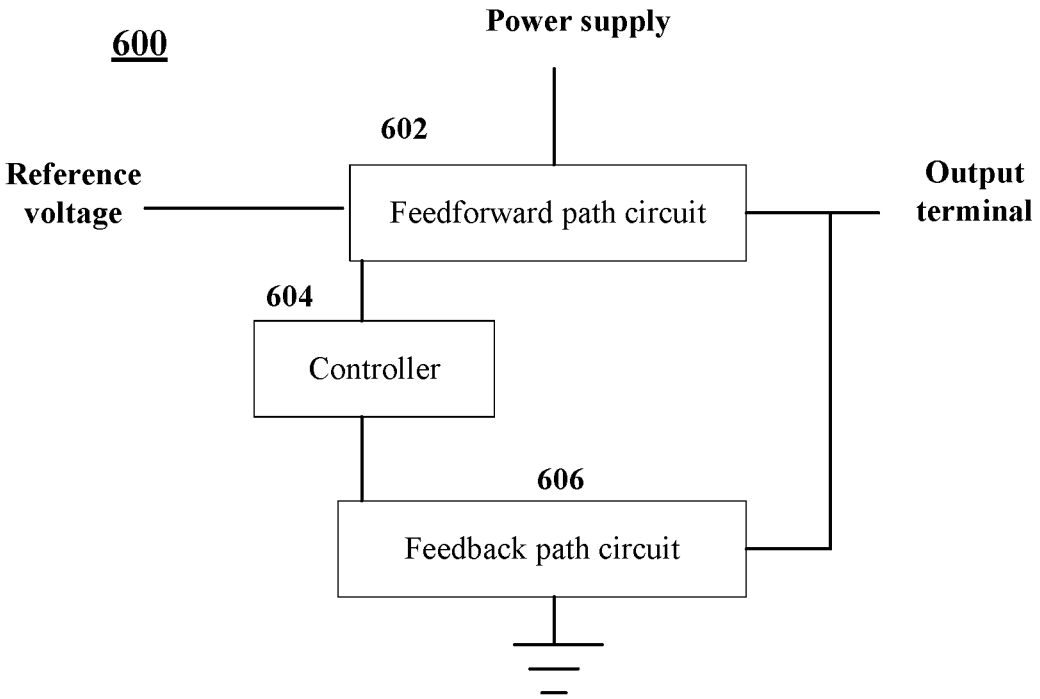
FIG. 6 shows an example of a low dropout regulator circuit according to some embodiments described herein.

As additional examples, in some embodiments, as depicted in FIG. 6, an electronic circuit 600 may include a feedforward path circuit 602, a feedback path circuit 604 and a controller circuit 606. The feedforward path circuit 602 may have a first terminal coupled to a reference voltage, a second terminal coupled to an output terminal and a third terminal coupled to a voltage source, the feedforward path circuit having a variable impedance.

The feedback path circuit 604 may be configured to provide a feedback voltage at a feedback terminal, wherein the feedback voltage represents a scaled value of the output voltage. The feedback path circuit may provide a feedback signal at a feedback terminal, which may be a voltage value, that represents a different between voltage at the output terminal at the reference voltage. The feedback signal may be used by the controller to adjust the variable impedance such that the variable impedance has a high (or highest) value when the electronic circuit is powered on and the difference between the output voltage and the reference voltage is at a maximum (e.g., output voltage value is zero and the reference voltage may have a nominal value of 1.5V or 3V or 5V, etc.). Correspondingly, when the difference between the output voltage and the reference voltage reduces, the controller may adjust the variable impedance to have a progressively lower and lower value such that the current being drawn from the reference voltage may vary as a piecewise smooth function of time. Some specific circuit examples are described with respect to FIG. 4.

The digital control logic 408 or the controller circuit 606 may be implemented using a microprocessor that executes software code, programmable logic, an electronic circuit, a field programmable gate array and the like.

Embodiments may also be described with reference to particular system configurations and networks. However, those skilled in the art will recognize that the features described herein are equally applicable to other system configurations, network types, etc. Moreover, the technology can be embodied as special-purpose hardware (e.g., circuitry), programmable circuitry appropriately programmed with software and/or firmware, or as a combination of special-purpose and programmable circuitry. Accordingly, embodiments may include a machine-readable medium having instructions that may be used to program a computing device to perform the methods described herein.

References in this description to "an embodiment" or "one embodiment" means that the particular feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the words "comprise" and "comprising" are to be construed in an inclusive sense rather than an exclusive or exhaustive sense (i.e., in the sense of "including but not limited to"). The terms "connected," "coupled," or any variant thereof is intended to include any connection or coupling, either direct or indirect, between two or more elements. The coupling/connection can be physical, logical, or a combination thereof. For example, two devices may be communicatively coupled to one another despite not sharing a physical connection.

When used in reference to a list of multiple items, the word "or" is intended to cover all of the following interpretations: any of the items in the list, all of the items in the list, and any combination of items in the list.

It will be appreciated that this patent document discloses techniques that may be embodied in various electronic circuits in which in-rush current when the electronic circuit is powered on is to be controlled. A low-drop out circuit is one such example. The electronic circuit that uses the technologies described herein may be used in battery operated products such as a Bluetooth based medical sensor device, a patient-wearable device, and so on.

It will further be appreciated that the disclosed techniques may be used in circuit embodiments and the power-on transient characteristics of current being drawn from a power source may be control to be a smooth function of time, such as a piecewise linear function, until a steady state is achieved.

The techniques introduced here, e.g., the gear shifting control logic 406, can be implemented by programmable circuitry (e.g., one or more microprocessors), software and/or firmware, special-purpose hardwired (i.e., non-programmable) circuitry, or a combination of such forms. Special-purpose circuitry can be in the form of one or more application-specific integrated circuits (ASICs), programmable logic devices (PLDs), field-programmable gate arrays (FPGAs), etc.

REMARKS

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

The invention claimed is:

1. A circuit, comprising:

a differential amplifier having a first input terminal coupled to a reference voltage source, a second input terminal coupled to a scaled version of an output voltage at an output terminal of the circuit, and a differential output terminal, wherein the differential amplifier is configured to produce, at the differential output terminal, a difference signal representing a difference between voltage signals at the first input terminal and the second input terminal;

an output stage coupled between a source terminal coupled to a voltage source and the output terminal of the circuit, the output stage further coupled to the differential output terminal, the output stage comprising multiple circuit branches positioned between the voltage source and the output terminal;

a control circuit that reduces a power-on current surge by controlling an impedance value of the output stage between the voltage source and the output terminal including varying at least one property of the multiple circuit branches based on a feedback signal so as to successively lower the impedance value after powering on the circuit until the circuit reaches a steady state operation; and a voltage divider circuit, wherein the voltage divider circuit is configured to produce the feedback signal as a fraction of an output voltage at the output terminal.

2. The circuit of claim 1, wherein the control circuit is configured to produce a first output control signal based on the feedback signal, the first output control signal controlling value of the fraction.

3. The circuit of claim 1, wherein the control circuit is configured to produce a second output control signal based on the feedback signal, the second output signal controlling a number of the multiple circuit branches electrically connected between the voltage source and the output terminal.

4. The circuit of claim 1, further comprising a resistive ladder between the output terminal of the circuit and a ground, wherein the fraction is achieved by position where the feedback signal is tapped from the resistive ladder.

5. The circuit of claim 1, wherein each of the multiple circuit branches comprises a transistor circuit.

6. The circuit of claim 5, wherein the transistor circuit comprises a Darlington pair of transistors.

7. The circuit of claim 1, wherein the circuit is a low drop-out regulator.

8. A method of controlling current being drawn by a circuit from a voltage source during power-up of the circuit, the method comprising:

operating, during a first time interval immediately after powering on the circuit, an output stage between the voltage source and an output terminal in a high impedance state; and operating, during successive time intervals after the first time interval and until the circuit reaches a steady state operation, the output stage in successively lower impedance states in which successively lower impedance is offered between the voltage source and the output terminal, thereby controlling a current drawn from the voltage source to be a piecewise smooth function of time and reducing a power-on current surge in the circuit.

9. The method of claim 8, further including:

generating, during the first time interval and the successive time intervals, a feedback signal that is a fraction of a value of voltage at the output terminal, wherein the fraction is changed for each time interval; and controlling the output stage to offer the successively lower impedance using a difference between the feedback signal and a reference signal at a reference terminal.

10. The method of claim 8, wherein durations of at least some of the successive time intervals are different from each other.

11. The method of claim 8, wherein the piecewise smooth function is a piecewise linear function.

12. The method of claim 8, wherein the smooth function is linear across all time intervals until the steady state operation of the circuit.

13. The method of claim 8, wherein the output stage comprises multiple transistor circuits, and wherein operating the output stage in successively lower impedance states includes controlling a number of the multiple transistor circuits that are electrically coupled and carrying current between the voltage source and the output terminal.

14. The method of claim 13, wherein the multiple transistor circuits include field effect transistors and wherein the controlling the number of the multiple transistor circuits includes controlling a gate bias voltage of the number of the multiple transistor circuits.

15. An electronic circuit, comprising:

a feedforward path circuit having a first terminal coupled to a reference voltage, a second terminal coupled to an output terminal and a third terminal coupled to a voltage source, the feedforward path circuit having a variable impedance;

a feedback path circuit configured to provide a feedback voltage at a feedback terminal, wherein the feedback voltage represents a scaled value of the output voltage; and a controller circuit coupled to the feedforward path circuit and the feedback path circuit and configured to reduce a power-on current surge by controlling the variable impedance based on the feedback voltage such that the value of the variable impedance is proportional to a difference between a voltage value of the voltage source and a voltage value at the output terminal so as to successively lower the variable impedance after powering on the circuit until the circuit reaches a steady state operation.

16. The electronic circuit of claim 15, wherein the feedforward path circuit includes a differential amplifier configured to produce, at the output terminal, a difference between the reference voltage and the scaled value of the output voltage.

17. The electronic circuit of claim 15, wherein the feedback path circuit comprises a resistive ladder and a switching circuit that switches resistors in the resistive ladder to change a factor by which the feedback path circuit scales the output voltage.

18. The electronic circuit of claim 15, wherein the controller circuit is configured to control the variable impedance such that an amount of current flowing through the feedforward path circuit changes with time as a piecewise linear function of time.

* * * * *